US011957282B2

(12) United States Patent
Christian

(10) Patent No.: US 11,957,282 B2
(45) Date of Patent: Apr. 16, 2024

(54) LIFT ASSIST DEVICE FOR A BATHROOM

(71) Applicant: Home Furnishings Resource Group Inc., Hermitage, TN (US)

(72) Inventor: Curt Christian, Hermitage, TN (US)

(73) Assignee: Home Furnishings Resource Group Inc., Hermitage, TN (US)

( * ) Notice: Subject to any disclaimer, the term of this patent is extended or adjusted under 35 U.S.C. 154(b) by 0 days.

(21) Appl. No.: 17/831,981

(22) Filed: Jun. 3, 2022

(65) Prior Publication Data

US 2023/0056591 A1 Feb. 23, 2023

Related U.S. Application Data

(60) Provisional application No. 63/196,453, filed on Jun. 3, 2021.

(51) Int. Cl.
*A47K 13/10* (2006.01)

(52) U.S. Cl.
CPC ..... *A47K 13/10* (2013.01)

(58) Field of Classification Search
CPC ..... A47K 13/10; A47K 11/04
USPC ..... 4/667
See application file for complete search history.

(56) References Cited

U.S. PATENT DOCUMENTS

| | | | |
|---|---|---|---|
| 3,039,818 | A | 6/1962 | Frank |
| 3,158,398 | A | 11/1964 | Stryker |
| 3,259,427 | A | 7/1966 | Wiest |
| 4,598,944 | A | 7/1986 | Meyer et al. |
| 4,778,217 | A | 10/1988 | Lane |
| 4,838,612 | A | 6/1989 | Cross |
| 4,907,303 | A | 3/1990 | Baird |
| 4,929,022 | A | 5/1990 | Geraci |
| 4,979,726 | A | 12/1990 | Geraci |
| 5,054,852 | A | 10/1991 | Tholkes |

(Continued)

FOREIGN PATENT DOCUMENTS

| | | | |
|---|---|---|---|
| CN | 207734286 | U | 8/2018 |
| DE | 202013101209 | U1 | 3/2013 |

(Continued)

OTHER PUBLICATIONS

International Search Report and Written Opinion in corresponding PCT Application No. PCT/US2022/032141, mailed Oct. 6, 2022, in 8 pages.

(Continued)

*Primary Examiner* — Christine J Skubinna
(74) *Attorney, Agent, or Firm* — Bradley Arant Boult Cummings LLP; Blake M. Bernard

(57) ABSTRACT

A lift-assist device is disclosed including a seat frame. A seat base can be pivotally coupled to the front side of the frame and moveable between a depressed and extended position. The seat base and seat frame are positionable over the toilet such that a central aperture on the seat base is positioned over the toilet bowl of the toilet. A first arm support can be coupled to the first lateral side of the seat frame and a extends from the top side of the seat frame. A first arm can be pivotally coupled to the first arm support about a point located between a front end and a rear end of the first arm, the rear end of the first arm supporting the seat base. A biasing member can be connected to the seat frame, the biasing member configured to bias the seat base in the extended position.

18 Claims, 9 Drawing Sheets

(56) References Cited

U.S. PATENT DOCUMENTS

| | | | | |
|---|---|---|---|---|
| 5,116,100 | A | 5/1992 | Iversen | |
| 5,161,812 | A | 11/1992 | DeWeese | |
| 5,203,610 | A | 4/1993 | Miller | |
| 5,375,911 | A | 12/1994 | Morrow | |
| 5,526,537 | A * | 6/1996 | Conrad | A47K 11/04 297/188.12 |
| 5,624,159 | A | 4/1997 | Celoni et al. | |
| 5,651,580 | A | 7/1997 | LaPointe et al. | |
| 6,161,229 | A | 12/2000 | Ryan et al. | |
| 6,352,138 | B1 | 3/2002 | Duran et al. | |
| 6,398,305 | B1 | 6/2002 | Ball et al. | |
| 6,449,783 | B1 * | 9/2002 | Moser | A61G 7/1094 4/667 |
| 6,454,285 | B1 | 9/2002 | Koenig | |
| 6,637,818 | B2 | 10/2003 | Williams | |
| 6,702,383 | B2 | 3/2004 | Newman et al. | |
| 6,779,848 | B1 | 8/2004 | Sanders et al. | |
| 6,783,179 | B2 | 8/2004 | Komura et al. | |
| 6,945,604 | B2 | 9/2005 | Splane, Jr. | |
| 7,021,713 | B2 | 4/2006 | Kao et al. | |
| 7,434,882 | B1 | 10/2008 | Hodges | |
| 8,360,518 | B2 | 1/2013 | Braaten | |
| 8,398,171 | B2 | 3/2013 | Lin et al. | |
| 8,740,304 | B2 | 6/2014 | Yu | |
| 8,876,138 | B2 | 11/2014 | Wilde | |
| 9,861,542 | B2 | 1/2018 | Christian | |
| 9,918,886 | B2 | 3/2018 | Splane, Jr. et al. | |
| 10,219,659 | B1 * | 3/2019 | Armstrong | A47K 11/06 |
| 10,327,970 | B2 | 6/2019 | Christian | |
| 10,874,564 | B2 | 12/2020 | Splane et al. | |
| 2005/0235414 | A1 * | 10/2005 | Cavanagh | A61G 7/1007 4/667 |
| 2006/0048296 | A1 | 3/2006 | Sutou et al. | |
| 2009/0188028 | A1 | 7/2009 | Jiang | |
| 2011/0248530 | A1 | 10/2011 | Sartisohn | |

FOREIGN PATENT DOCUMENTS

| | | | |
|---|---|---|---|
| EP | 2808001 | A1 | 12/2014 |
| FR | 2639807 | A1 | 6/1990 |
| GB | 2183150 | A | 6/1987 |
| GB | 2205230 | A | 12/1988 |
| JP | 2001-258795 | A | 9/2001 |
| WO | WO 2010/120225 | A1 | 10/2010 |
| WO | WO 2022/256639 | A1 | 12/2022 |

OTHER PUBLICATIONS

International Search Report and Written Opinion in PCT Application No. PCT/US2016/038438, dated Sep. 8, 2016, in 7 pages.

* cited by examiner

LIFT ASSIST DEVICE FOR A BATHROOM

CROSS-REFERENCES TO RELATED APPLICATIONS

This application is a non-provisional of U.S. Patent Application No. 63/196,453 filed Jun. 3, 2021 entitled LIFT ASSIST DEVICE FOR A BATHROOM which is hereby incorporated by reference in its entireties.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The presently-disclosed subject matter generally relates to a lift assist device for a seat to be placed in bathroom, such as a toilet chair or a shower chair. In particular, embodiments of the presently-disclosed subject matter relate to a device that can assist an individual sitting and/or standing from a chair or a toilet.

More particularly, the present disclosure relates to lift assist devices for users of conventional toilets and showers. Toilets generally have a bowl and a toilet seat which users can sit on when using the restroom. Conventional toilets are generally positioned relatively low to the ground. Sitting or standing from a seated position on a toilet can be difficult or impossible for certain people. For example, the elderly, disabled, injured, or other individuals may find it difficult or impossible to controllably lower themselves into a seated position on a toilet. Similarly, certain individuals may lack the strength or flexibility to stand from a seated position on a toilet. Difficulties in sitting or standing from chairs can impact the safety and well-being of such individuals. For instance, individuals may injure themselves attempting to sit or stand from a chair when they lack the physical strength or flexibility to do so.

Toilet chairs have long been in existence which can be placed over a toilet and/or toilet seat to help raise the level or height at which a user is positioned from the ground while using the toilet to ease in sitting and standing from the toilet. Such toilet seats can have arm rests which the user can grab onto to help the user push themselves off the toilet seat. However, for many patients, such toilet chairs can still be difficult to sit on and/or stand up from, and present the same difficulties as the user sitting or standing out of a conventional chair. Some individuals lack the strength required to sit or stand from a chair even when they utilize their arm strength to brace themselves. Such individuals are unable to sit or stand without personal assistance. Accordingly, such individuals have reduced mobility, which can lead to other ailments, and may also become depressed or feel hopeless because their mobility and comfort is dependent on the assistance of others.

Such toilet seat chairs can also be bulky and take of a lot of room in the bathroom when not in use. Furthermore, in pushing themselves out of the chair, an individual may inadvertently cause the chair to slide out from under the individual. This can cause an individual to incur addition strain or to fall. Such falls can result in serious injury, particularly if the individual is suffering from osteoporosis or other diseases or conditions. Serious injury can also occur if the individual hits their head in a fall. For this reason, accidental falls from chairs account for a substantial proportion of injuries in nursing homes, assisted living facilities, and the like.

Additionally, users of standing showers such as the elderly, disabled, injured, pregnant, sick, and other individuals with physical limitations may find it difficult to stand in the shower for long periods of time. Such users will often place shower chairs in the shower to sit on, but many such users have difficulty standing from the chair once finished. Additionally, difficulty standing can be dangerous in the very slippery conditions of a shower setting.

What is needed then are improvements in chair and sitting devices for bathrooms.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the present disclosure is a lift-assist device for a toilet having a toilet bowl, the device including a seat frame having a front side, a first lateral side, and a second lateral side, a bottom side, and a top side. A seat base is disposed on the top side of the seat frame that is pivotally coupled to the front side of the seat frame, the seat base being moveable with respect to the seat frame between a depressed position and an extended position. The seat base has a central aperture extending through the seat base, the seat base and frame positionable over the toilet such that the central aperture is positioned over the toilet bowl of the toilet when the seat base is in the depressed position. A first arm support can have a proximate end that is coupled to the first lateral side of the seat frame and a distal end that extends from the top side of the seat frame. A first arm can have a front end and a rear end, the first arm being pivotally coupled to the first arm support about a point located between the front end and the rear end of the first arm, the rear end of the first arm supporting the seat base. A biasing member can be connected to the seat frame, the biasing member configured to bias the seat base in the extended position.

The biasing member can include a lifting force on the seat base which can aid the user in standing from a sitting position as the biasing member can help move the seat base from the depressed position to the extended position. Having the arm be pivotable on the arm support and the rear end of the arm supporting the seat base can allow the user to also push down on the front end of the first arm to effectively lift the back of the seat base via the rear end of the first arm to further provide a lift assist force on the seat base.

In some embodiments, the seat frame and or the seat base can be connectable to a conventional toilet to replace a conventional toilet seat and cover on the toilet such that the lift assist device can be secured to the toilet for added support and stability which can help prevent slippage of the lift assist device during use. In some embodiments, the frame can include one or more support legs which can rest on the ground when the lift assist device is positioned over the toilet. In other embodiments, the frame, and thus the lift assist device, can be suspended from the toilet seat when the frame and or seat base is secured to the toilet such that the lift assist device essentially replaces a conventional toilet seat on a toilet.

Another aspect of the present disclosure is a lift-assist device for a shower, the device including a seat frame having a front side, a first lateral side, and a second lateral side, a bottom side, and a top side. A seat base is disposed on the top side of the seat frame and is pivotally coupled to the front side of the seat frame, the seat base being moveable with respect to the seat frame between a depressed position and an extended position. The seat base has a plurality of drainage apertures defined therein. A first arm support can have a proximate end that is coupled to the first lateral side of the seat frame and a distal end that extends from the top side of the seat frame. A first arm can have a front end and a rear end, the first arm being pivotally coupled to the first arm support about a point located between the front end and the rear end of the first arm, the rear end of the first arm extending beneath the seat base. A biasing member can be connected to the seat frame, the biasing member configured to bias the seat base in the extended position.

Numerous other objects, advantages and features of the present disclosure will be readily apparent to those of skill in the art upon a review of the following drawings and description of a preferred embodiment.

DETAILED DESCRIPTION

Figure 1:
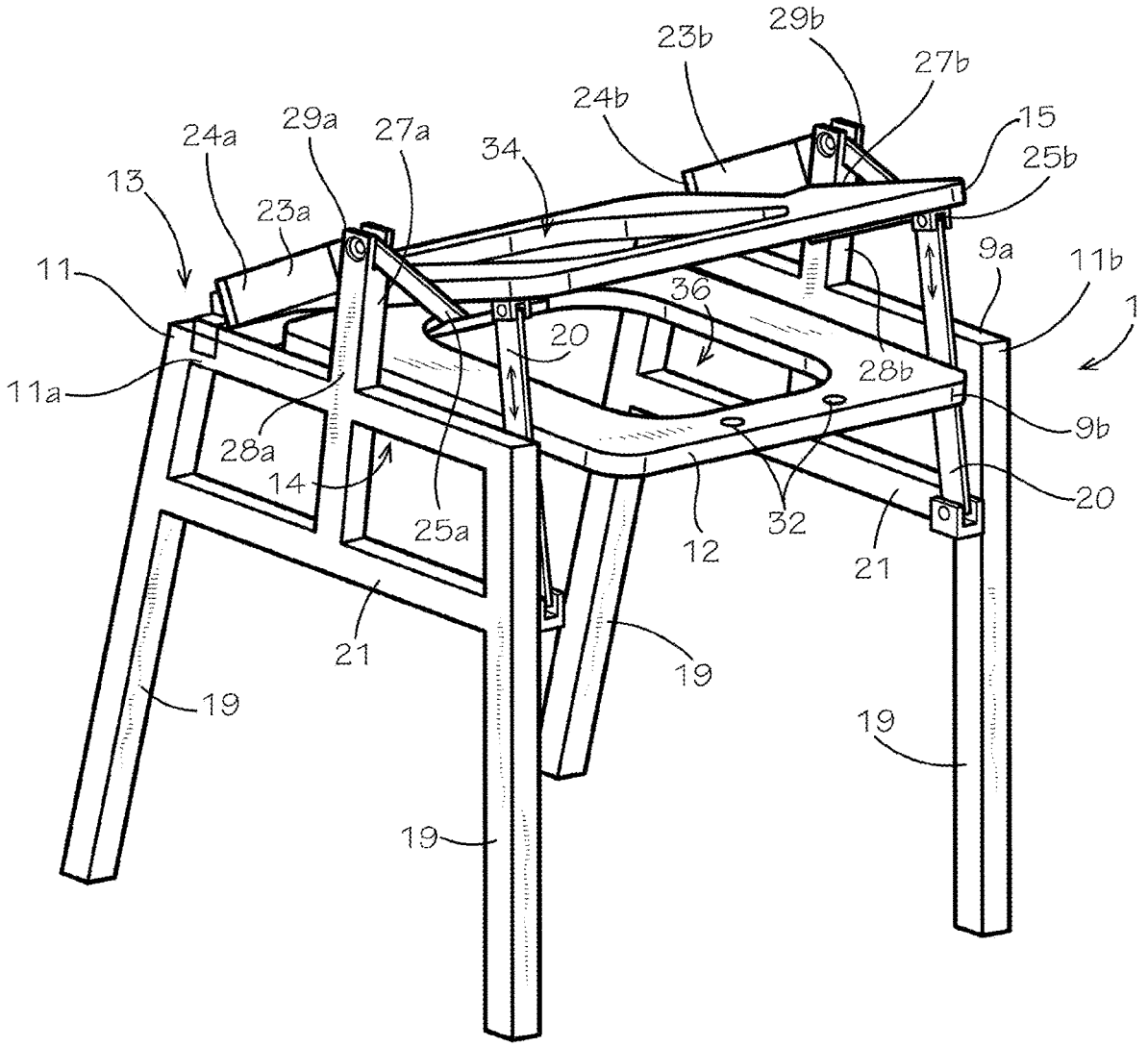
FIG. 1 is a right side rear perspective view of an embodiment of a lift assist device of the present disclosure.
Figure 2:
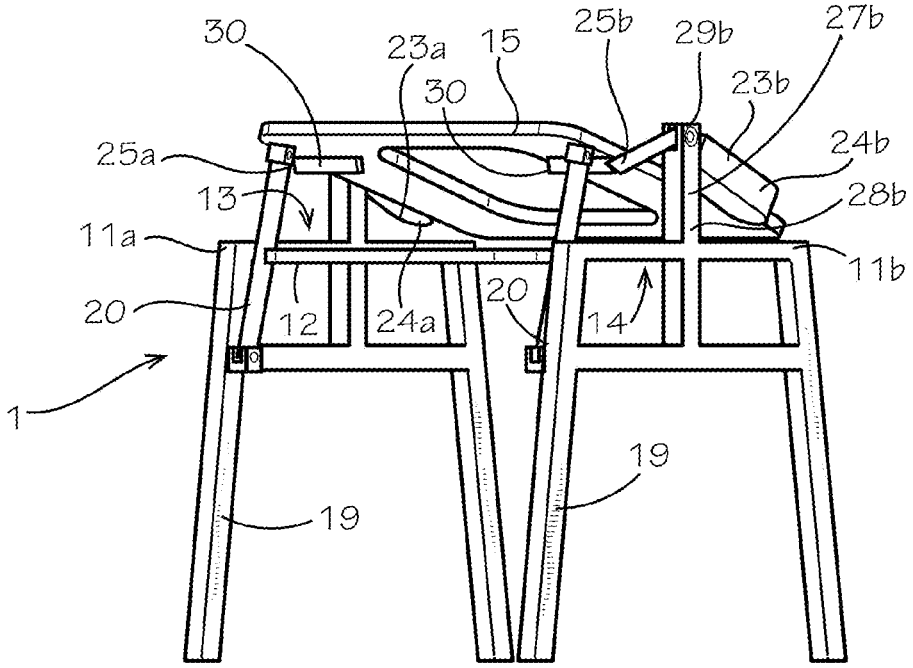
FIG. 2 is a left side rear perspective view of the lift assist device of FIG. 1
Figure 3:
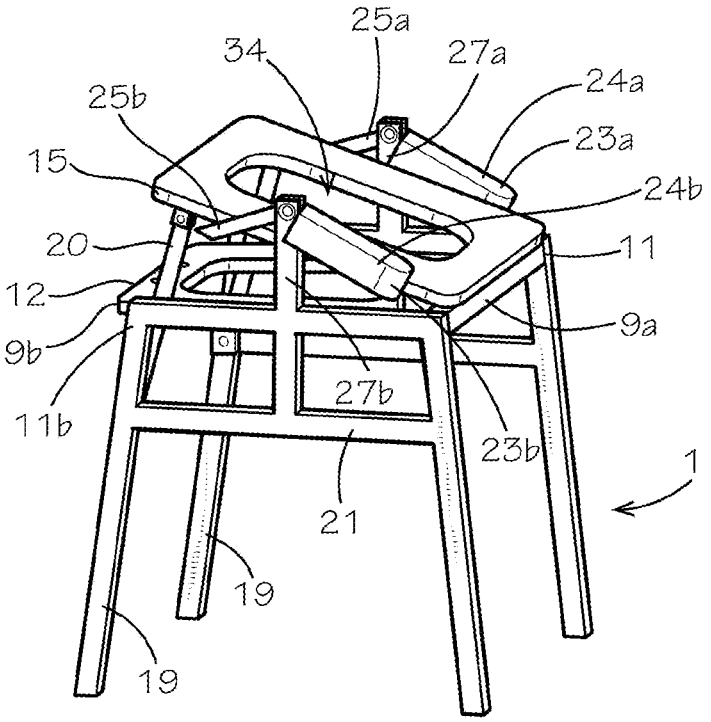
FIG. 3 side perspective view of the lift assist device of FIG. 1.
Figure 4:
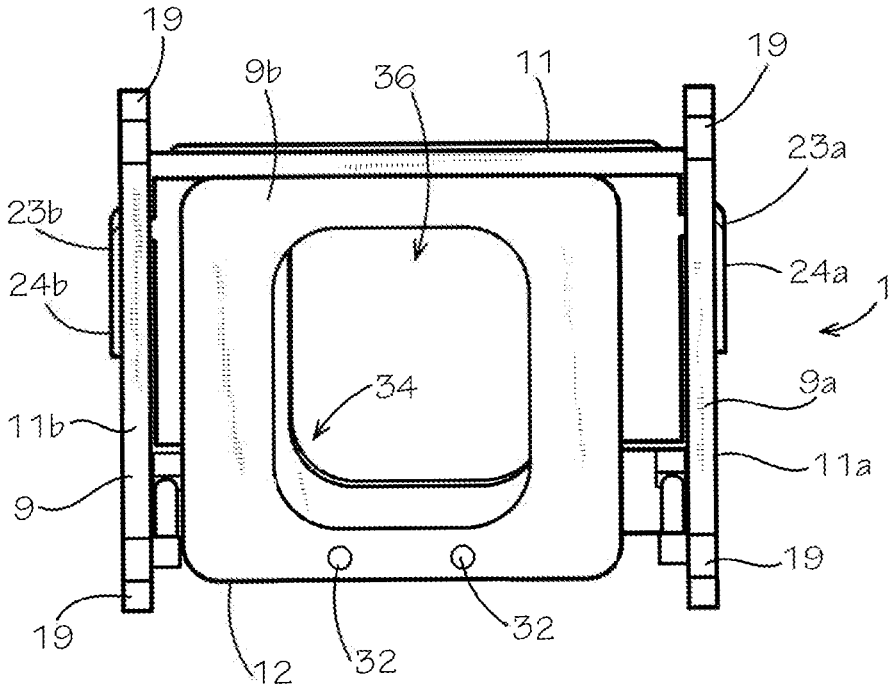
FIG. 4 bottom view of the lift assist device of FIG. 1.
Figure 5:
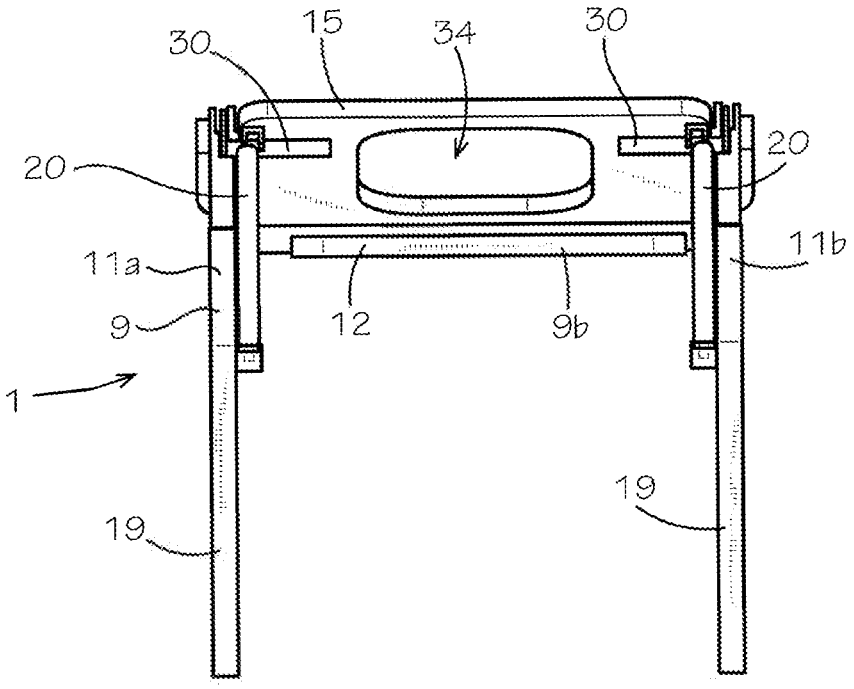
FIG. 5 rear view of the lift assist device of FIG. 1.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

As described herein, an upright position of one embodiment of a lift assist device 1 for a toilet is shown in FIG. 1 is considered to be the position of apparatus components while in proper operation as described herein. Vertical, horizontal, front, rear, top, bottom, and other orientation terms are described with respect to the orientation of the lift assist device 1 shown in FIG. 1 unless otherwise specified. Likewise, front refers to a side facing away from the viewer in FIG. 1, rear refers to a side facing toward the viewer from the perspective shown in FIG. 1, and lateral sides refer to left and right sides of the lift assist device 1 and its components as shown in FIG. 1.

The presently-disclosed subject matter includes a lift assist device 1 for a bathroom that can provide lift-assistance and is referred to as a lift-assist toilet chair, shower chair, bathroom chair, or toilet seat herein. The presently-disclosed chairs or toilet seats are configured such that an individual can have additional assistance when sitting into a toilet chair or toilet seat relative to conventional toilets and toilet chairs. Embodiments of the presently-disclosed toilet chairs or toilet seats can also be configured such that an individual can have additional assistance when standing from the toilet chair or toilet seat relative to conventional toilets or toilet chairs. In some embodiments, the presently-disclosed toilet chairs or toilet seats are configured such that an individual is assisted when sitting onto the toilet chair or toilet seat as well as when standing from the toilet chair or toilet seat. Accordingly, the presently-disclosed lift-assist toilet chairs or toilet seats can aid elderly, disabled, injured, pregnant, sick, and other individuals when sitting and/or standing. Such individuals may otherwise have difficulty or be unable to lower themselves into a seated position or raise themselves from a seated position on a standard toilet.

A perspective view of an embodiment of a lift-assist device 1 is shown in FIGS. 1-7. The lift assist device 1 can resemble a traditional toilet chair in its assembled state in some embodiments.

The toilet chair 1 includes a seat frame 9. In the embodied toilet chair 1 the seat frame 9 can made from metal tubing, though solid metal pieces could be used to construct the frame as well. In other embodiments, the seat frame 9 can be made from any suitable material, including but not limited to plastics, composites, or wood. The seat frame 9 includes a front side 11, a first lateral side 11*a*, and a second lateral side 11*b*, such that the frame forms a U or C-shaped structure that can be positioned over and/or around a toilet when in use. In some embodiments, the seat frame 9 can also include a rear side 12.

In some embodiments, as shown in FIG. 1, the seat frame 9 can include a peripheral frame structure 9*a* and a central frame base 9*b* extending from at least one side of the peripheral frame structure 9*a*, or spanning between at least two sides of the peripheral frame structure 9*a*. In some embodiments, either the peripheral frame structure 9*a* or the frame base 9*b* can be securable to the toilet to stabilize the lift assist device 1 to the toilet 5. In other embodiments, the seat frame 9 can include just a peripheral frame structure 9*a* that forms a central opening providing access to the toilet bowl of a toilet 5 when the lift assist toilet chair 1 is positioned over the toilet 5. In still other embodiments, seat frame 9 can include only a single plate shaped body with a central aperture defined therein. Securing the seat frame 9 to the toilet 5 can help prevent movement or slipping of the lift assist device 1 when in use which can help prevent falling and or injury to a user. The frame base 9*b* in some embodiments can also be configured to rest on a toilet 5 when the lift assist-device 1 is in use to provide additional stability of the toilet chair 1 over the toilet 5. In the embodied toilet chair 1, the rear side 12 corresponds to a rear end of the generally rectangular frame base 9*b* of the seat frame 9, but in some embodiments, the peripheral frame structure 9*a* can also include a rearward frame member that forms the rear side 12. In this regard, the term "side" generally refers to an area of a structure located along a given side of the structure. For instance, the term "lateral side" refers to both the physical lateral side of a structure as well as top and bottom surface areas provided along the lateral side of the structure.

Furthermore, the rear side 12 corresponds to a rearwardly disposed component that spans between the lateral sides 11*a* and 11*b*. However, in other embodiments the rear side 12 does not correspond to the rear end of a seat frame. For instance, in some embodiments the seat frame forms a generally U-shaped structure, and rear side corresponds to components that extend from corresponding lateral sides 11*a* and 11*b* along the lengths of the lateral sides 11*a* and 11*b*, or the rear ends of the lateral sides 11*a* and 11*b*.

The components that comprise the sides of the seat frame 9 are configured in some embodiments in an arrangement having a substantially rectangular shape. In other embodiments, the seat frame 9 can form a generally trapezoidal, semicircular, circular or other suitable shape. In some embodiments the seat frame 9 is comprised of fewer than four components, and in other embodiments the seat frame 9 is comprised of more than four components. In other embodiments a seat frame 9 can take any shape that is appropriate for the intended use of a chair. The components of a seat frame are not particularly limited, and in some embodiments are comprised of a material selected from wood, composite, polymer, metal, or the like. In yet other embodiments, the seat frame 9 can be comprised of a unitary component, such as a continuous metal sheet or the like.

The toilet chair 1 can also include two or more legs 19 extending downward from the seat frame 9. In some embodiments, the toilet chair 1 can include four legs 19 that extend from a bottom side 14 of the seat frame 9. A leg may refer to any structure that can support a toilet chair 1 and the weight of an individual sitting on the toilet chair 1. In some embodiments, a leg 19 is comprised of a single component that supports a toilet chair 1 at a desired height. In other embodiments a toilet chair 1 can include three or more legs configured to support the toilet chair 1. Legs 19 that extend from a bottom side 14 of a seat frame 9 include legs that are coupled indirectly or directly to a bottom side 14 of a seat frame 9 as well as legs 19 that are coupled to other portions of a toilet chair 1 and that extend downwardly relative to a bottom side of the seat frame 9. Support legs 19 may also be integrally formed with the seat frame 9 in some embodiments.

In this regard, the term "couple" is used interchangeably herein with the terms "connect," "mount," "attach," and the like to refer to a connection between distinct components, including both permanent and non-permanent connections between components as well as both direct and indirect connections between components. For instance, two components may be coupled together by welds, bolts, screws, adhesives, or the like. In some instances components that are not mechanically or chemically adhered together may be referred to as being coupled together if they are arranged such that movement of one component directly translates into movement of the other component.

The lift assist toilet chair 1 includes a seat base 15. In some embodiments, the seat base 15 can be rigid or made from substantially rigid materials. In some embodiments the seat base 15 is comprised of one or more materials that have cushioning properties, but can still be quickly and conveniently cleaned and/or sterilized as needed. In other embodiments the seat base 15 can be made of a more rigid material such as a hard plastic, and a seat cushion can be provided as a separate component on a top side of a seat base 15. The seat cushion can be connected to the seat base 15 by any suitable mechanical or chemical adhesive, including nails, screws, staples, tape, glue, straps, or the like. Thus, the term seat base 15 as used herein refers to seat bases 15 that may or may not comprise a seat cushion, wherein the seat cushion can be defined by the seat base, a separate component that is supported and/or provided on the seat base 15, or integral with the seat base 15.

The seat base 15 can be pivotally connected to the front side 11 of the seat frame 9, such that the seat base 15 can be movable between an extended position as shown in FIGS. 1-7, or a depressed position wherein the seat base 15 is lowered to a substantially horizontal orientation. In some embodiments, the seat base 15 can be positioned against a portion of the seat frame 9 when the seat base 15 is in the depressed position. The seat base 15 can include a central aperture 36 defined in the seat base 15 which can allow a user to expel waste through the central aperture 36 and into the toilet bowl 6 when the seat base 15 is in the depressed position. In some embodiments wherein the seat frame 9 includes a frame base 9*b*, the frame base 9*b* can also include a frame base aperture 34 which can be aligned with the central aperture 36 in the seat base 15 when the seat base 15 is in the depressed position. A user can then expel waste through both the central aperture 36 and the frame base aperture 34 and into the toilet bowl 6 of the toilet.

As shown in FIGS. 1-7, rear and side views of the toilet chair 1 are shown. The legs 19 of toilet chair 1 in some embodiments can include leg supports 21 or cross supports provided proximate the top end of the legs 19. The leg supports 21 connect adjacent pairs of legs 19 and are configured to provide additional structural rigidity to the legs 19 of the chair 1.

In other embodiments any number and a variety of different shapes, sizes, and configurations of leg supports 21 may be provided at any location along the legs 19 in order to enhance the chair aesthetically, structurally, or both. For instance, leg supports 21 may offer additional structural support to the toilet chair 1 by minimizing stress at junctions between the legs 19 and the seat frame 9 or between the legs 19 and a seat base 15. Thus, in some instances leg supports 21 can increase the horizontal forces that a toilet chair 1 can bear. In other embodiments a chair includes legs 19 that do not include leg supports.

In the embodied toilet chair 1, each pair of legs 19 extend from one leg support 21, and each pair of legs 19 form a substantially U-shaped structure with the corresponding leg support 21. The two pairs of legs 19 and leg supports 21 are placed side-by-side, and top sides of the legs 19 are mounted to a bottom side 42 of a seat frame 9 in order to connect the four legs 19 and the seat frame 9 to form a single structure. In the embodied chair the seat base 15 is comprised of a flat plate. In other embodiments the seat frame 9 is integral with the top of the legs or any other structure that supports the toilet chair 1.

In some embodiments, the seat frame 9 and/or the seat base 15 may include a back frame, which can be disposed toward the rear side 12 of the seat frame 9 and extends upwardly relative to a top side 13 of the seat frame 9. In some embodiments the back frame is coupled or integrally formed with a rear side of a seat frame 9. The back frame is configured to support an individual in the seated position. Embodiments of back frames can be configured to have any suitable shape or size. Depending on the intended use of a chair 1, the back frame 3 relative to the seat frame 9 can form an angle of about 90 degrees to about 180 degrees, including about 90, 95, 100, 105, 110, 115, 120, 125, 130, 135, 140, 145, 150, 155, 160, 165, 170, 175, or 180 degrees, including and ranges there between. In some embodiments the angle of the back frame relative to the seat frame is adjustable.

Figure 6:
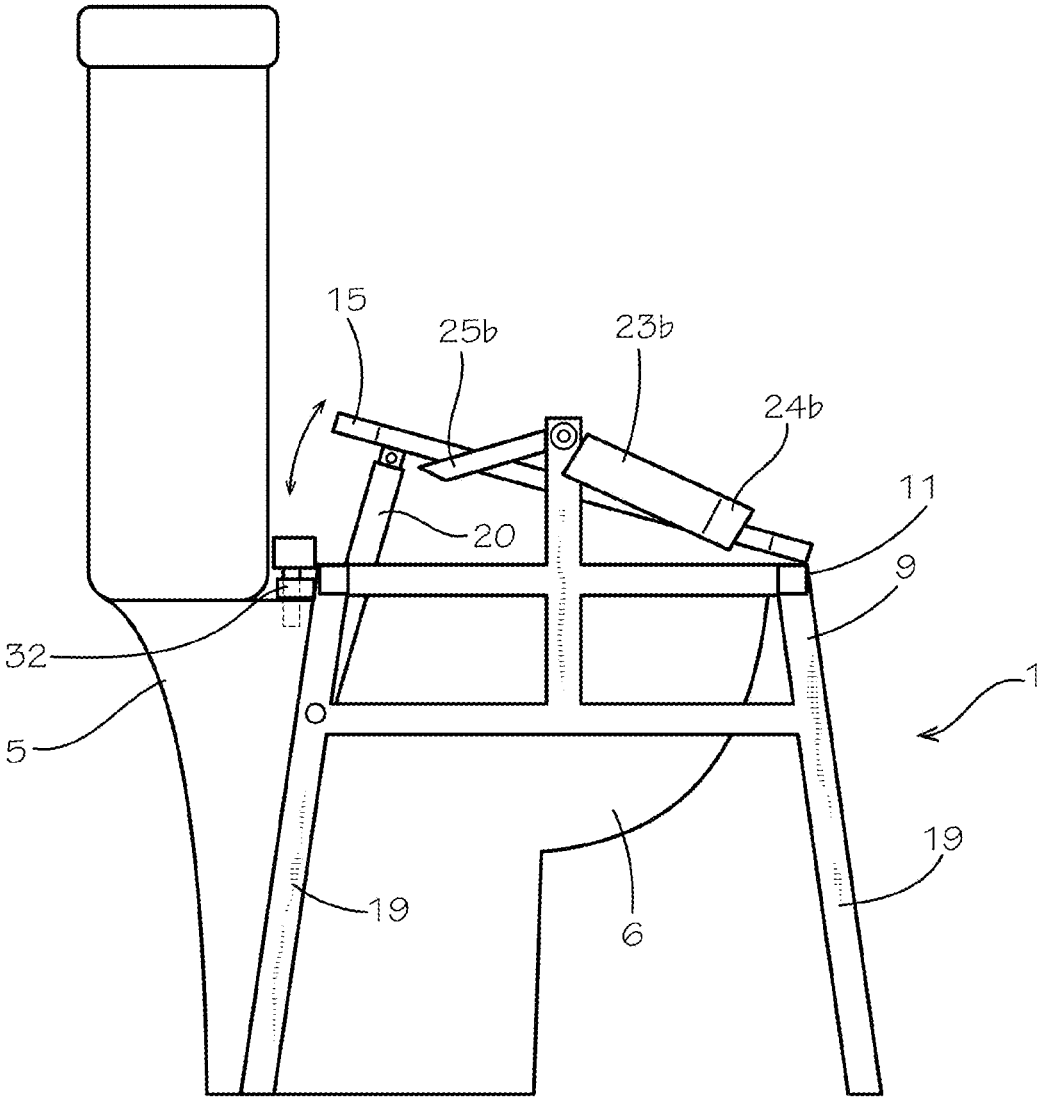
FIG. 6 a side view of the lift assist device of FIG. 1 installed over a toilet.
Figure 7:
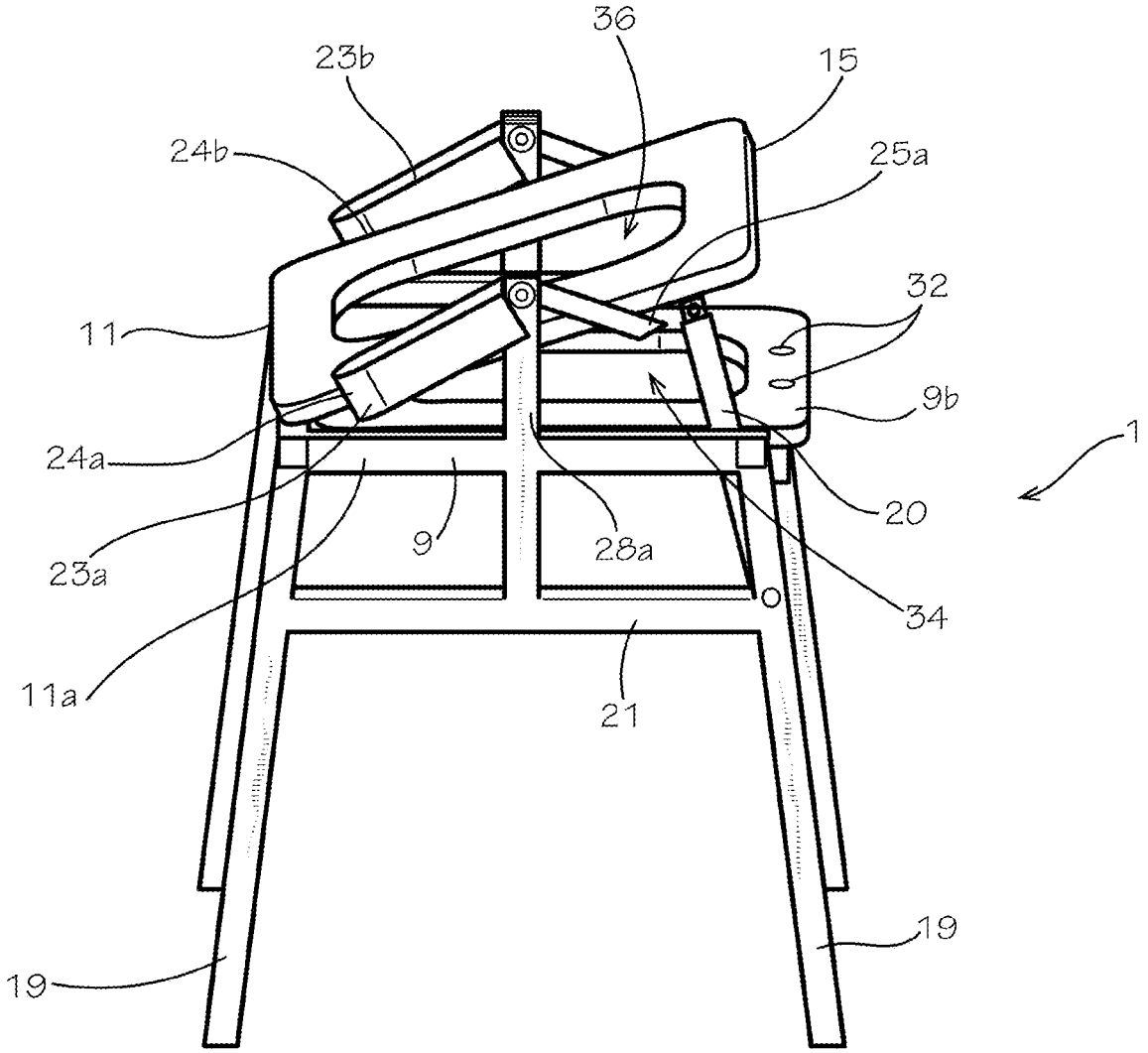
FIG. 7 is a top perspective view of the lift assist device of FIG. 1.

FIG. 6 also illustrates that the chair 1 includes legs 19 that extend from a bottom side 14 of the seat frame 9. In some embodiments, the legs 19 extend at an angle relative to a plane defined by the seat frame 9, and each leg 19 can extend generally from one of the four corners of the seat frame 9. The angling of the legs 19 can provided additional stability for the toilet chair 1.

As noted previously, in some embodiments, the seat frame 9 can be securable to the toilet 5 to provide additional stability for the toilet chair 1 and to ensure that the toilet chair 1 is properly aligned over the toilet bowl 6 of the toilet 5 when in use, such that the central aperture 34 of the seat base is aligned over the toilet bowl 6 when the user sits in the toilet chair 1 to move the seat base 15 to the depressed position. Toilets typically are equipped with two mounting screws or mounting holes to which a conventional toilet seat can be connected. In some embodiments, the seat frame 9 can further include a pair of connection apertures 32 which can be aligned with the mounting screws or mounting holes on the toilet 5 such that the toilet chair 1 can be connectable to the toilet 5 via the connection apertures in the seat frame 9. In some embodiments, the connection apertures can be formed along a rear member of the peripheral frame structure 9*a*, or the connection apertures 32 can be formed in the frame 9*b* base positioned beneath the seat base 15. In some embodiments, the connection apertures 32 in the frame base 9*b* can be located in a rearward direction from the frame base aperture 34, such that when the connection apertures 32 are aligned with the mounting screws or mounting holes in the toilet 5, the frame base aperture 34 of the frame base 9*b* is positioned properly over the toilet bowl 6.

Referring again to FIGS. 1-7, the toilet chair 1 can include arms 23*a*, 23*b*. A first arm support 27*a* is provided on the first lateral side 11*a* of the seat frame 9. A proximate (bottom) end 28*a* of the first arm support 27*a* can be coupled to and/or integrally formed with the first lateral side 11*a* of the seat frame 9. In some embodiments the arm support 27*a* is coupled to a side or a top of the corresponding lateral side 11*a* of the seat frame 9. In other embodiments, the arm support 27*a* is coupled directly to a top side 13 of the seat frame 9. In yet other embodiments the arm support is coupled to the seat frame in any manner that permits the seat base to move between a depressed position and an extended position with respect to the seat frame.

The distal (top) end 29*a*, of the first arm support 27*a* extends upwardly relative to a top side 13 of the seat frame 9. A first arm 23*a* is provided that has a length and includes a front end 24*a* and a rear end 25*a*. The first arm 23*a* is pivotally coupled to first arm support 27*a* so that the first arm 23*a* can move about its connection point with the first arm support 27*a*. Accordingly, the front end 24*a* and the rear end 25*a* of the first arm 23*a* move in opposite vertical directions as the first arm 23*a* is pivoted about its connection point with the first arm support 27*a*.

Any of the pivoting connections or couplings described herein can be achieved by any means known in the art. For instance, a first component may be bolted to a second component so that it can pivot about an axis that is defined by the bolt. In other instances a pivoting coupling can be achieved by permitting movement of two component as they move in relation to one another. For instance, in embodiments wherein a seat base 15 rests on a top surface of rear end 25*a* of an arm 23*a* without being fixedly fastened thereto, the seat base 15 can pivot with respect to the arm connector as they move in relation to one another. Furthermore, in some embodiments pivoting couplings can include two components that are fixedly fastened to one another, wherein at least one of the components is flexible so that the components may be moved respect to each other.

In some embodiments, the first arm includes a shape that is angled or curved such that when the front end 24*a* of the first arm 23*a* is in a horizontal orientation the rear end 25*a* is positioned below the front end 24*a*. The rear end of the first arm 23*a* can be coupled to a rearward portion of the seat base 15 in a manner that permits movement of the arm to translate into movement of the seat base 15. The first arm 23*a* can be coupled either directly or indirectly through another component, such as an extension member 30 extending from a rear end 25*a* of the first arm 23*a*, which can be positioned beneath a rear of the seat base 15. In other embodiments, the first arm 23*a* can include multiple first arm components, including one component pivotally connected to the first arm support 27*a*, and a second component connected to the first component and coupled to the seat base 15 for moving the seat base 15 between a depressed position and an extending position as the first arm 23*a* pivots about the first arm support 27*a*. In some embodiments an arm may or may not comprise a bracket for coupling to a seat base.

As described herein, the chair 1 can further comprise a second arm 23*b*, and a second arm support 27*b* disposed on the second lateral side 5*b* of the seat frame 9. In the embodied chair 1, the second arm 23*b* and the second arm support 27*b*, and the second arm connector 29*b* are configured to mirror the first arm 23*a* and the first arm support 27*a*, respectively. Accordingly, in some embodiments all the statements made herein with respect to a first arm 23*a* are applicable to the corresponding second arm 23*b*.

On other embodiments a first arm 23*a* will differ from a corresponding second arm 23*b*. For instance, in some embodiments only one of a first arm 23*a* or a second arm 23*b* are configured to pivot and move a seat base 15 between a depressed and an extended position, whereas the other arm is stationary and does not influence the movement of the seat base 15. In other embodiments, corresponding first and second arms 23*a* and 23*b* are not symmetrical. Possible differences between corresponding first and second arms 23*a* and 23*b* in other embodiments will be appreciated by those of ordinary skill upon reviewing this document.

The arms can be modified or adjusted depending on the intended use or design of a chair. In some embodiments the front end 24*a* of an arm defines a handle having an aesthetically pleasing design and/or being configured to be comfortable for placement of an individual's hands. In some embodiments the arms 23*a* and 23*b* can be comprised of two or more separate components that together function as an arm.

FIGS. 1-7 show side the toilet chair 1 in an extended position. Once a user sits in the toilet chair 1 on the seat base 15, the seat base 15 can be moved to the depressed position. The chair 1 in the depressed position represents a configuration when a force is applied to the top side of the seat base 15 by the user to overcome the biasing member 20 discussed further herein. The depressed position can therefore represent a position of the seat base 15 when an individual is seated on the chair 1. In the depressed position the seat base 15 and the seat frame 9 are both substantially horizontal and substantially parallel to one another. That is, a plane defined by the seat base 15 is substantially parallel (e.g., within about 15 degrees of each other) to a plane defined by the seat frame 9. In other embodiments the seat base 15 and the seat frame 9 in the depressed position are substantially parallel but are not horizontal. For instance, it may be desirable to have a chair that has a seat base that is tilted forward or backwards in the depressed position so that the chair has an inclined or declined seated position.

The toilet chair 1 in the extended position represents a configuration when no force or a force insufficient for depression is applied to the top side 13 of the seat base 15. The extended position can therefore represent a position of the seat base 15 when an individual is not seated on the toilet chair 1. In the extended position the seat base 15 is angled relative to the seat frame 9, the angle being generally defined by the tilt of the seat base 15 relative to the seat frame 9. In some embodiments the angle of the seat base relative to the seat frame in the extended position is about 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, or 90 degrees, including any ranges and values there between. In some embodiments the angle of the seat base 15 relative to the seat frame 9 in the extended position is about 5 to about 90 degrees. In some embodiments, the front end 24*a* of the first arm 23*a* can be heavier or weighted relative the rear end 25*a* of the first arm 23*a*, such that when the seat base 15 is in the extended position, the rear end 25*a* of the first arm 23*a* can be biased toward the seat base 15 by the weight of the front end 24*a* of the first arm 23*a*. The rear end 25*a* of the first arm 23*a* can include a support extension 30 that extends beneath and engages an underside of the seat base 15.

In this regard, the toilet chair 1 is provided with one or more hinges (not shown) along a front side 11 of the seat frame 9. A front side of the seat base 15 is coupled to the hinges that are provided along the front side 11 of the seat frame 9. In this manner, the seat base 15 is pivotally coupled to the front side 11 of the seat frame 9. The hinges permit the seat base 15 to tilt with respect to the seat frame 9 between the depressed position and the extended position. Other embodiments comprise other configurations for achieving such movement of a seat base 15 relative to a seat frame 9. For instance, in some embodiments the hinges are substituted for other pivoting or flexible components that permit the seat base to pivot with respect to the seat frame. In other embodiments hinges or other pivoting or flexible components are provided on other portions of the seat frame depending on the arrangement of the seat base relative to the seat frame.

In some embodiments, the toilet chair 1 can include a seat stop that is disposed on the top side 13 of the seat frame 9. The seat stop includes one or more objects that, when the seat base in the depressed position, stop movement of the seat base 15 relative to the seat frame 9. In the embodied seat frame 9, the frame base 9*b* can act as the seat stop prevent further motion of the seat base 15 beyond the frame base 9*b*. The material and configuration of the seat stop is not particularly limited. In some embodiments one or more components comprise a seat stop that determine the position of the seat base in the depressed position. The seat stop may be arranged at any suitable location and in any suitable pattern on the top side 13 of the seat frame 9. Alternatively or additionally, seat stops that determine the position of a seat base 15 in the depressed position may be provided on an arm support or another portion of the toilet chair 1. In some embodiments the seat stop is integral with a seat frame. The seat stops may be made of any suitable material, including metal, wood, felt, rubber, plastic, or the like.

The toilet chair 1 can include one or more biasing members 20 coupled between the seat base 15. In some embodiments, the one or more biasing member 20 can be a pair of mechanical or pneumatic springs 20 which can be coupled or secured to the seat frame 9 and the seat base 15 that are configured to bias the seat base 15 in the extended position. In FIGS. 1-7, the biasing member 20 is shown as a pneumatic spring pivotally connected at one end to the seat base 15 and at the other end to the seat frame 9. The pivotal connection to both the seat base 15 and the seat frame 9 can allow the pneumatic spring to adjust its alignment between the seat base 15 and the seat frame 9 to accommodate the movement of the seat base 15. By virtue of being coupled between the seat frame 9 and the seat base 15, the springs 20 exert a force against the bottom side of the seat base 15. Thus, the springs 20 can assist movement of the seat base 15 from a depressed position to an extended position. In some embodiments the springs 20 can independently move a seat base 15 from a depressed position to an extended position, and in other embodiments the springs in conjunction with the force applied by an individual via the arms 23*a* and 23*b* can move the seat base 15 from a depressed position to an extended position. The springs 20 can also reduce the rate at which the seat base 9 moves from an extended position to a depressed position. The biasing members 20 can assist an individual in achieving controlled and gradual movement of the seat base 15 into the depressed position via compression of the biasing members 20, while also providing an additional lifting force on the seat base 15 as the user stands or rises from the toilet chair 1 to provide an additional lifting force on the seat base 15. Embodiments of the present toilet chairs can comprise any number of such springs or other biasing or compression mechanisms.

Figure 13:
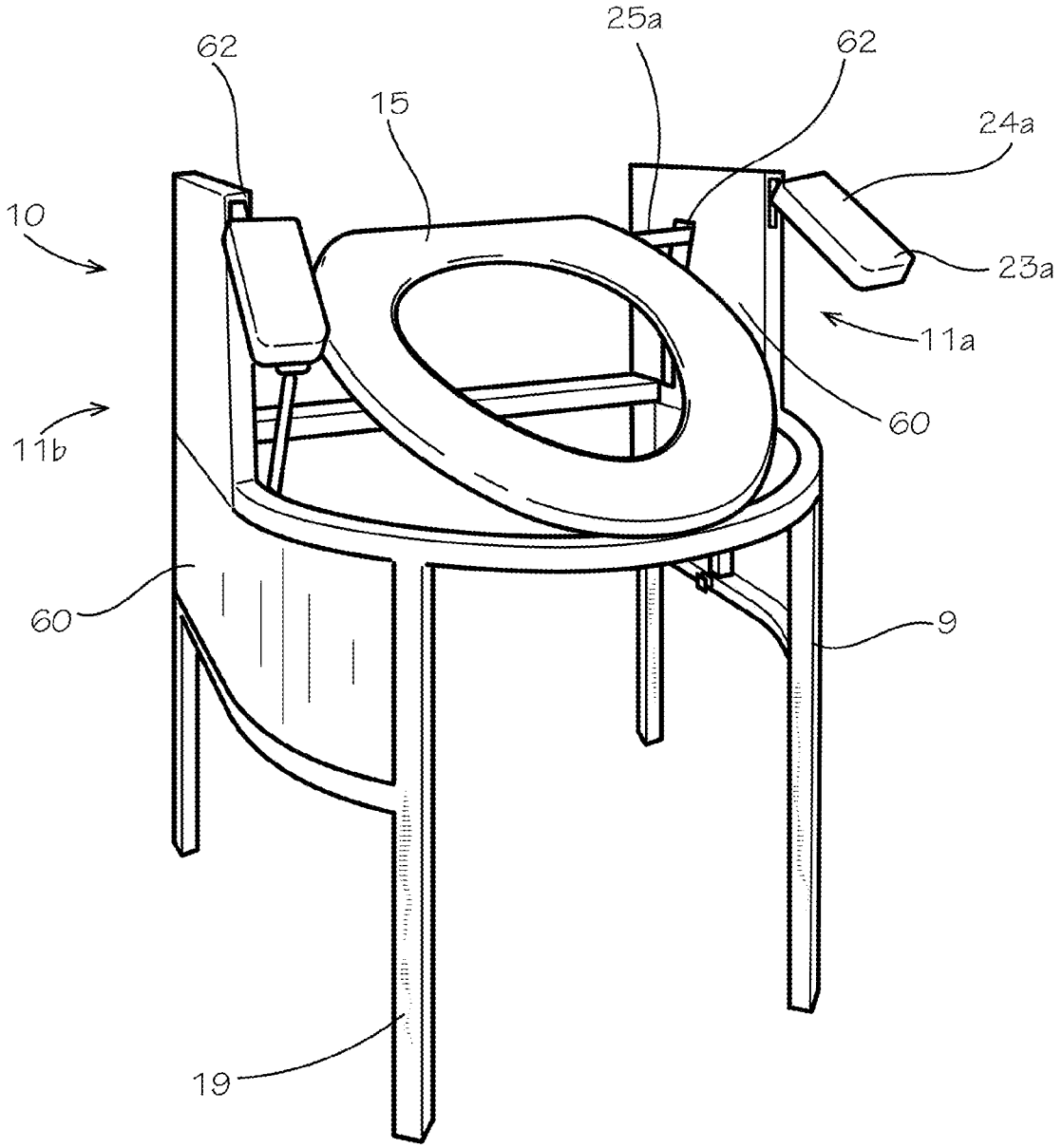
FIG. 13 is a perspective view of another embodiment of a lift assist chair of the present disclosure having side panels to at least partially cover the internal mechanics of the lifting mechanism of the chair.

In some embodiments, as shown in FIG. 13, the toilet chair 1 can further include side panels 60 provided on the lateral sides 11*a* and 11*b* of the chair 1. A portion of each of the first arm 23*a* and the second arm 23*b* can extend from openings 62 provided in the side panels 60 to allow a user to utilized the front ends 24*a* and 24*b* of the arms 23*a* and 23*b* respectively to assist in lifting the user out of the toilet chair 1 via the lifting force applied by the arms 23*a* and 23*b* to the seat base 15. Additionally, the rear portions 25*a* and 25*b* of the arms 23*a* and 23*b* can extend through recesses 62 in the side of the panels 60 to support seat base 15. The recesses 62 in the side of the panels 60 can help guide and provide stability for the arms 23*a* and 23*b* during movement of the seat base 15 on seat frame 9. In some embodiments side panels 60 provide a covering for the mechanical components of a toilet chair 1 which can provide additional stability and/or an preferred aesthetic appearance for the toilet chair 1. Thus, embodiments of coverings of different shapes and sizes can be provided depending on the intended use of a chair.

A method for operating the embodied lift-assist toilet chair 1 will now be described. When sitting, an individual can apply a downward force on the front ends 24 the arms 23. As shown in FIGS. 1-7, this downward force 42 causes the arms 23 to pivot about their connection points with the arm supports 27 so that the rear ends 25 of the arms 23 lift upwardly. In turn, as the rear ends 25 of the arms 23 lift upwardly which cause the rear side of the seat base 15 to also lift upwardly. This configuration, wherein the front ends 24 of the arms 23 are pivoted downward to lift the seat base 15, is referred to herein as the "extended position."

An individual may apply force on the seat base 15 as they lower themselves into the chair 1 to sit. During this time, one may continue to apply a desired amount of downward force on the front ends 24 of the arms 23 in order to counteract the force of their weight on the seat base 15. Furthermore, since the seat base 15 is tilted upwardly in the extended position, the distance an individual must lower themselves before making contact with the toilet chair 1 is decreased relative to a traditional toilet chair. These factors help reduce the strain that is placed on an individual's legs and arms as they attempt to lower themselves into a seated position, and also permits individuals to sit in a more gradual and safe manner.

As an individual continues to lower themselves, the seat base 15 will lower to a point that the seat base 15 contacts the seat frame 9 or a seat stop on the seat frame 9. A position wherein an individual is seated on the chair 1 is referred to herein as the "depressed position." The mass of an individual in a seated position can hold the arms 23 in a fixed position.

Those of ordinary skill in the art will appreciate that the presently-disclosed lift-assist chair can provide numerous advantages. For those who are disabled, injured, elderly, or the like, the chair can greatly ease the process of sitting and standing. The chair also provides numerous safety benefits. For instance, because one is assisted when sitting and/or standing, abrupt forces or movements can be decreased, which can decrease the risk of having a chair slide out from under a under. Sitting gradually also minimizes any potential risk of imbalance that may be caused by quickly sitting or falling into a chair.

The presently-disclosed chair 1 can also assist an individual who desires to stand from a seated position. As one prepares to stand, they can apply a downward force on the front ends 24 of the arms 23. This downward force on the front end(s) 24 of the arms 23 can apply an upward force on the seat base 15 via the rear ends 25 of the arms 23 and tilt the seat base 15 upwardly from a depressed position to an extended position. As the individual begins to stand, the seat base 13 will continue moving upwardly to assist the individual to stand up from a seated position. In this manner, one can utilize both upper body strength and mass to facilitate standing from the chair 1.

In this regard, the location and arrangement of the seat frame 9, the arm supports 27, the arms 23, and the seat base 15 can be altered depending on the particular configuration of a chair. For instance, the configuration of these elements can be altered to increase or decrease the amount of leverage the arms provide when moving the seat base relative to the seat frame. In some embodiments a proximate end of an arm support can be coupled to a lateral side of a seat frame at any location between a rear side 12 and a front side 11 of the seat frame. Similarly, in some embodiments the distal end of an arm support can be coupled to an arm at any location between a front end 24 and a rear end 25 of the arm. Furthermore, the rear ends 25 of the arms 23 can be coupled at varying points on the seat base 15.

Figure 8:
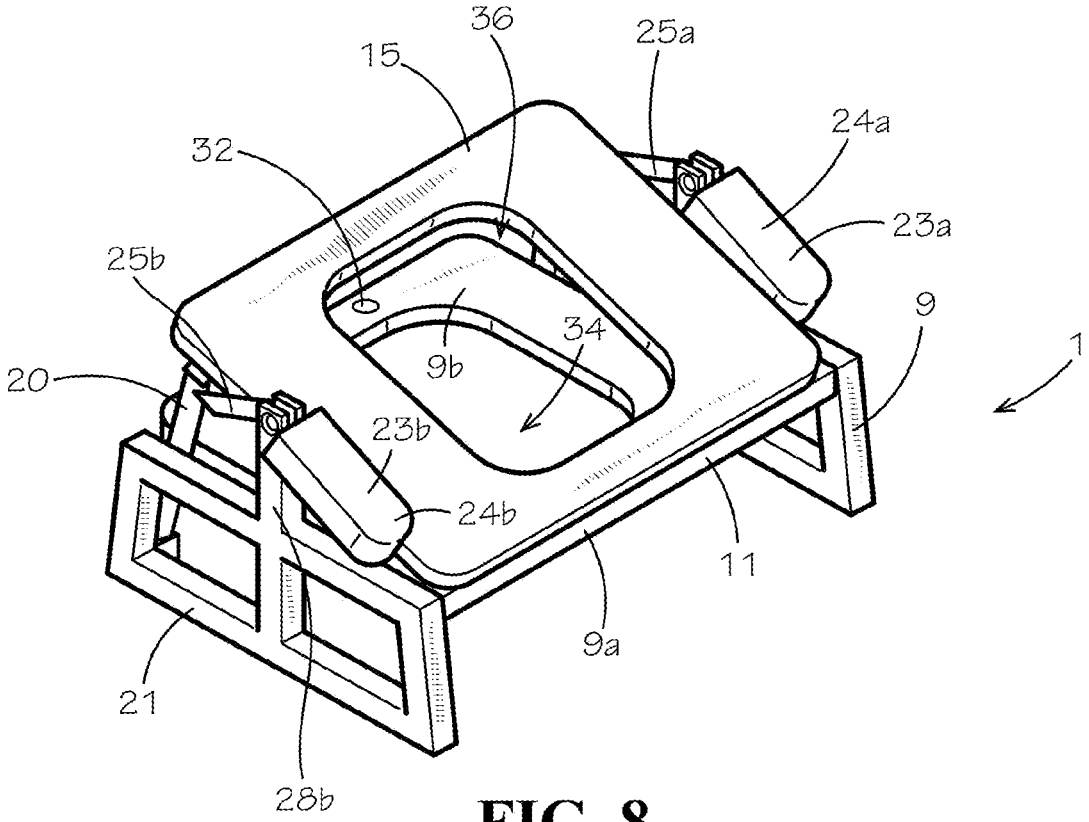
FIG. 8 is a top perspective view of another embodiment of a lift assist device of the present disclosure designed to rest atop and be suspended by the toilet.
Figure 9:
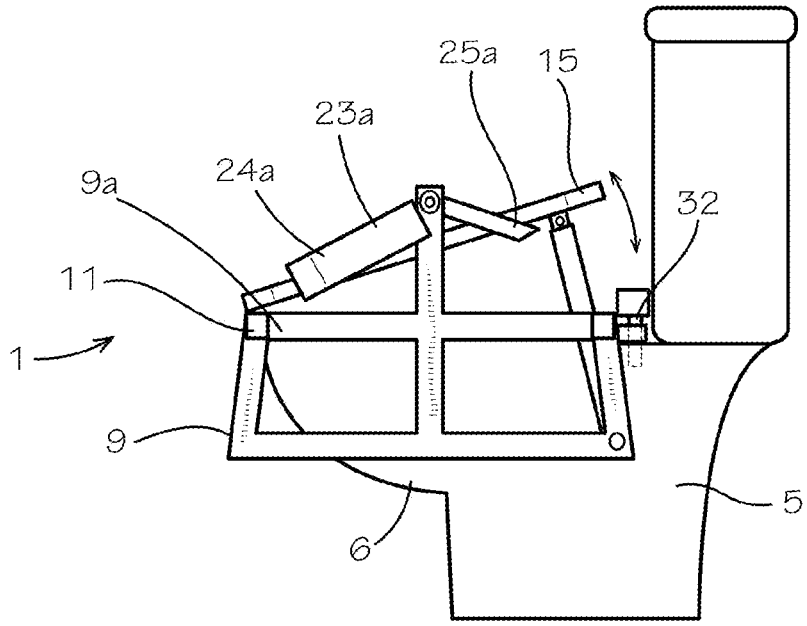
FIG. 9 is a side view of the lift assist device of FIG. 8 secured to a toilet.

Another embodiment of a lift assist device is shown in FIGS. 8-9. The embodiment of FIGS. 8-9 is substantially similar to the toilet chair 1 of FIGS. 1-7, except the embodiment of FIGS. 8-9 does not include any legs such that the lift assist device 1 can rest on a toilet 5 or be secured to the toilet 5 via similar toilet connection apertures in the frame 9 of the lift assist device 1 such that the lift assist device 1 can be suspended from the toilet 5, which can help reduce the space required and footprint for the lift assist device 1 in what are often times smaller bathrooms. In such embodiments, the lift assist device 1 can replace conventional toilet seats on standard toilets 5.

Figure 10:
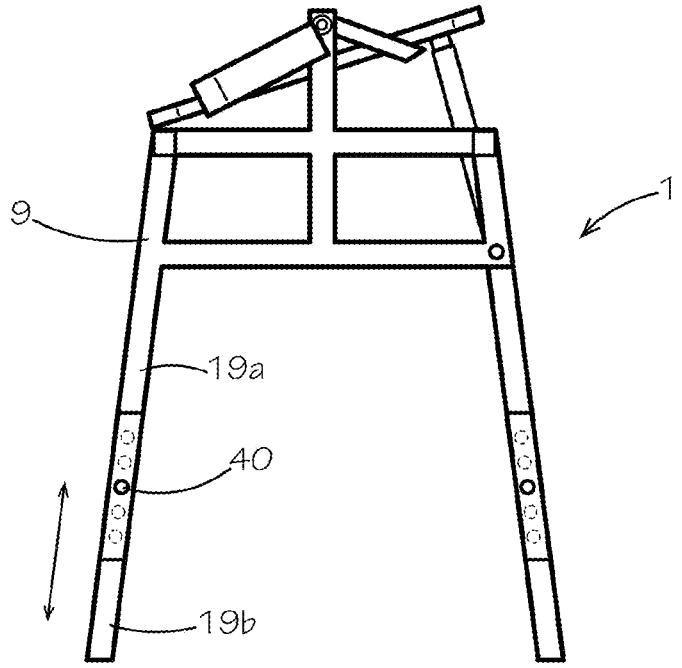
FIG. 10 is a side view of another embodiment of a lift assist device of the present disclosure including a seat frame with adjustable legs.
Figure 11:
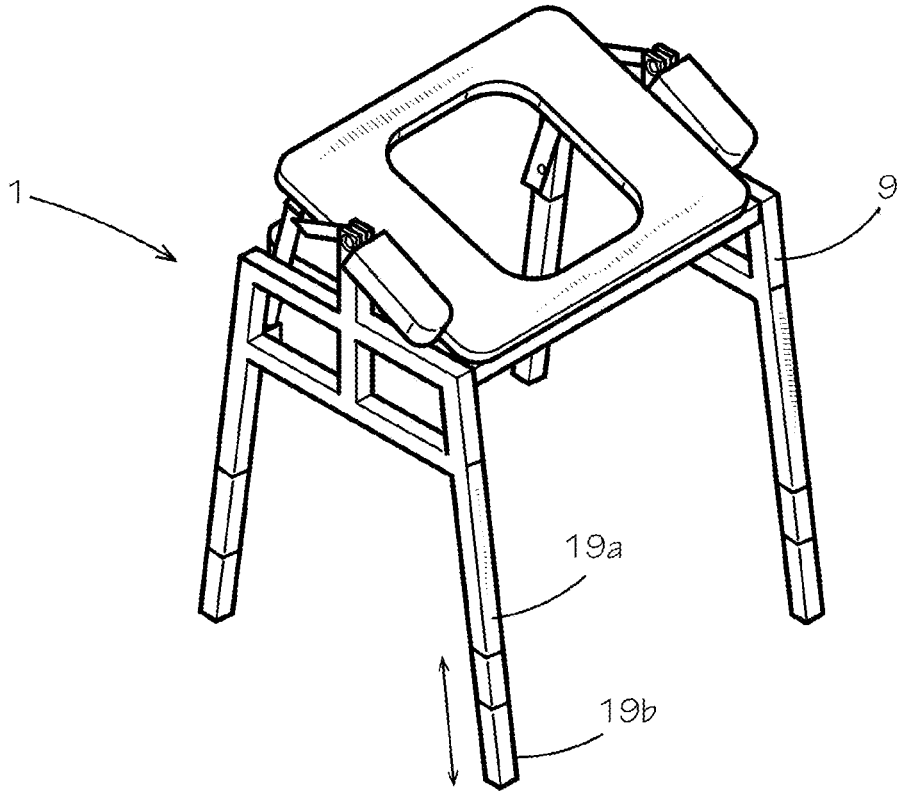
FIG. 11 is a perspective view of another embodiment of a lift assist device of the present disclosure including a seat frame with telescoping legs.

In still other embodiments, as shown in FIGS. 10-11, the toilet chair 1 can include legs 19 that are adjustable such that the height of the seat base 15 can be adjusted to the users preferences. In FIGS. 10-11, the adjustment mechanism includes telescoping leg members 19*a* and 19*b* with a biased depressible button 40 on one leg member received in another leg member with holes configured to receive the depressible button 40 to adjust the height of the toilet chair 1. Any other suitable height adjustment mechanism can be used, including releasable clamps, threadingly engaged leg members or feet for the legs, etc.

Figure 12:
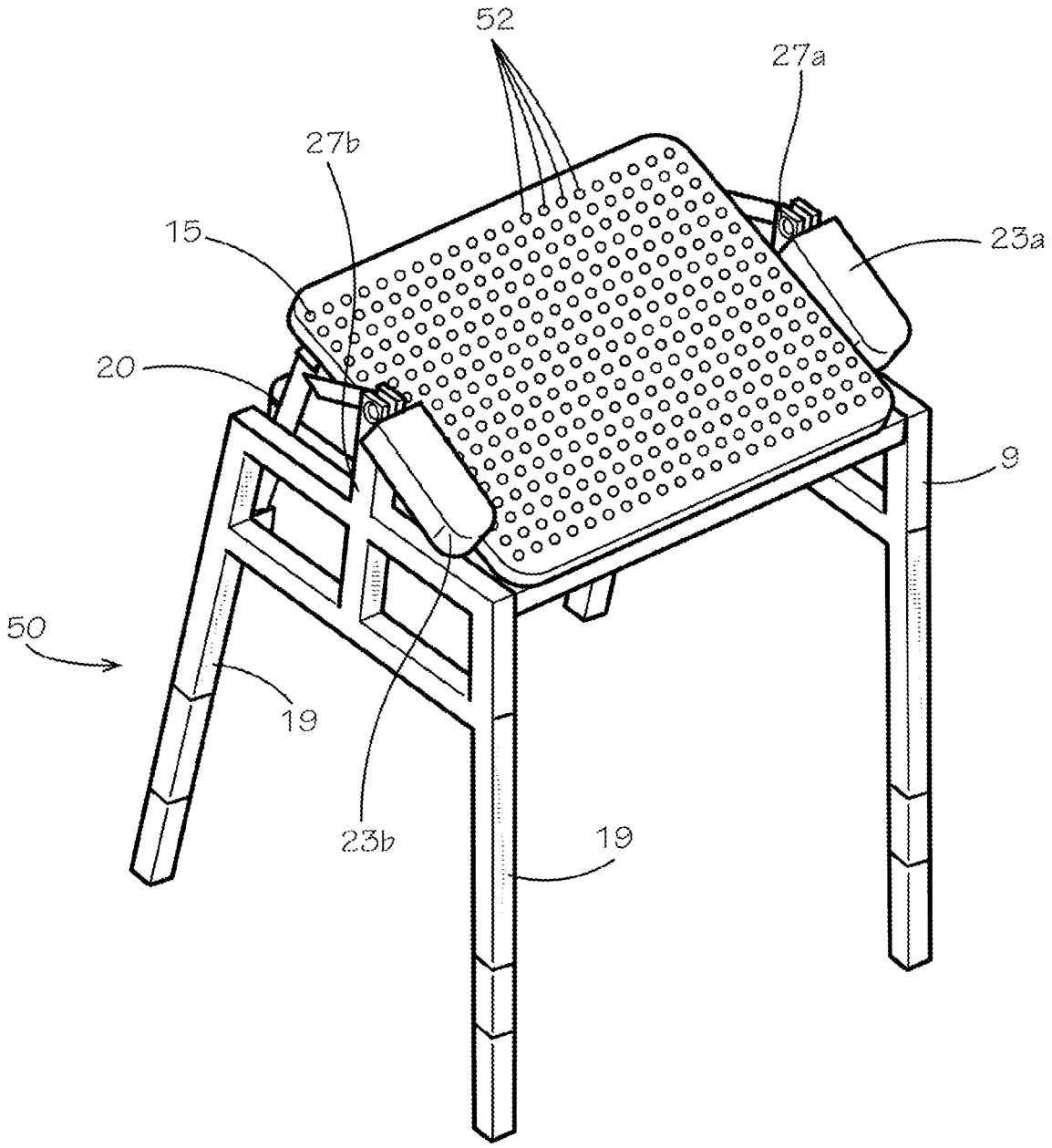
FIG. 12 is a perspective view of another embodiment of a lift assist chair of the present disclosure for use in a shower.

Yet another aspect of the present disclosure is a shower chair 50, as shown in FIG. 12. The shower chair 50 have similar components as those in the toilet chair 1 of FIGS. 1-7, including but not limited to a seat frame 9, movable seat base 15, legs 19 and/or adjustable legs, biasing members 20, arms 23 and arm supports 27, etc. However, the seat base 15 can be a generally rectangular member with a plurality of small drainage holes 52 defined across the seat base 15 which can allow water from the shower to drain from the top of the seat base 15. However, the same lift assist and sit assist mechanisms/features of the toilet chair 1 can be incorporated into the shower chair 50.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

The term "component" as used herein refers to a discrete element that alone or in combination with other element forms a part of a chair. For instance, in some embodiments an arm can be comprised of a single component or an arm can be comprised of a plurality of components that are coupled together to form an arm.

As used herein, the term "about," when referring to a value or measurement is meant to encompass variations of in some embodiments ±50%, in some embodiments ±40%, in some embodiments ±30%, in some embodiments ±20%, in some embodiments ±10%, in some embodiments ±5%, in some embodiments ±1%, in some embodiments ±0.5%, and in some embodiments ±0.1% from the specified amount, as such variations are appropriate.

Unless defined otherwise, all technical and scientific terms used herein have the same meaning as commonly understood by one of ordinary skill in the art to which the presently-disclosed subject matter belongs. Certain definitions are set forth to facilitate explanation of the presently-disclosed subject matter.

All references to singular characteristics or limitations of the present disclosure shall include the corresponding plural characteristic(s) or limitation(s) and vice versa, unless otherwise specified or clearly implied to the contrary by the context in which the reference is made.

Thus, although there have been described particular embodiments of the present invention of a new and useful LIFT ASSIST DEVICE FOR A BATHROOM, it is not intended that such references be construed as limitations upon the scope of this invention.

What is claimed is:

1. A lift-assist device for a toilet having a toilet bowl, the device comprising:

a seat frame having a front side, a first lateral side, and a second lateral side, a bottom side, and a top side;

a seat base disposed on the top side of the seat frame that is pivotally coupled to the front side of the seat frame, the seat base being moveable with respect to the seat frame between a depressed position and an extended position, the seat base having a central aperture extending through the seat base, the seat base and frame positionable over the toilet such that the central aperture is positioned over the toilet bowl of the toilet;

a first arm support having a proximate end that is coupled to the first lateral side of the seat frame and a distal end that extends from the top side of the seat frame;

a first arm having a front end and a rear end, the first arm being pivotally coupled to the first arm support about a pivot point located between the front end and the rear end of the first arm, the rear end of the first arm supporting the seat base; and a biasing member connected to the seat frame, the biasing member configured to bias the seat base in the extended position.

2. The device of claim 1, wherein the biasing member is a pneumatic or hydraulic spring device.

3. The device of claim 1, wherein the seat frame is connectable to the toilet.

4. The device of claim 1, wherein the seat frame further comprises a frame base positioned beneath the seat base, the frame base connectable to the toilet, the frame base including a frame base aperture that is substantially aligned with the central aperture in the seat base when the seat base is in the depressed position.

5. The device of claim 4, wherein the seat frame further includes a plurality of legs extending in a direction away from the seat base.

6. The device of claim 5, wherein the plurality of legs are adjustable in height.

7. The device of claim 4, wherein the seat frame includes a pair of toilet connection apertures defined through a rear portion of the frame base.

8. The device of claim 1, further comprising:

a second arm support having a proximate end that is coupled to the second lateral side of the seat frame and a distal end that extends from the top side of the seat frame;

a second arm having a front end and a rear end, the second arm being pivotally coupled to the second arm support about a point located between the front end and the rear end of the second arm, the rear end of the second arm extending beneath the seat base.

9. The device of claim 1, wherein the biasing member further comprises:

a first pneumatic or hydraulic spring positioned adjacent the first lateral side of the seat frame; and a second pneumatic or hydraulic spring positioned adjacent the second lateral side of the seat frame.

10. The device of claim 1, wherein the first and second pneumatic or hydraulic springs are each pivotally connected between the seat frame and the seat base.

11. The device of claim 1, wherein when a downward force is applied on the front end of the first arm support, the rear end of the arm support applies a force on the seat base in a direction toward the extended position.

12. The device of claim 1, wherein the front end of the first arm in front of the pivot point is heavier than the rear end of the first arm behind the pivot point.

13. A lift-assist device for a toilet having a toilet bowl, the device comprising:

a seat frame having a front side, a first lateral side, and a second lateral side, a bottom side, and a top side;

a seat base disposed on the top side of the seat frame that is pivotally coupled to the front side of the seat frame, the seat base being moveable with respect to the seat frame between a depressed position and an extended position, the seat base having a central aperture extending through the seat base, the seat base and frame positionable over the toilet such that the central aperture is positioned over the toilet bowl of the toilet;

a first arm support having a proximate end that is coupled to the first lateral side of the seat frame and a distal end that extends from the top side of the seat frame;

a first arm having a front end and a rear end, the first arm being pivotally coupled to the first arm support about a pivot point located between the front end and the rear end of the first arm, the rear end of the first arm extending beneath the seat base to support the seat base; and at least one pneumatic or hydraulic spring pivotally connected between the seat frame and the seat base, at least one pneumatic or hydraulic spring configured to bias the seat base in the extended position.

14. The device of claim 13, further comprising:

a first pneumatic or hydraulic spring positioned adjacent the first lateral side of the seat frame; and a second pneumatic or hydraulic spring positioned adjacent the second lateral side of the seat frame.

15. The device of claim 13, wherein the rear end of the first arm is biased against a rear portion of the seat base.

16. The device of claim 13, further comprising:

a second arm support having a proximate end that is coupled to the second lateral side of the seat frame and a distal end that extends from the top side of the seat frame;

a second arm having a front end and a rear end, the second arm being pivotally coupled to the second arm support about a point located between the front end and the rear end of the second arm, the rear end of the second arm extending beneath the seat base.

17. The device of claim 13, wherein the seat frame further includes a plurality of adjustable legs extending in a direction away from the seat base.

18. A lift-assist device for a toilet having a toilet bowl, the device comprising:

a seat frame having a front side, a rear portion, a first lateral side, and a second lateral side, a bottom side, and a top side;

a pair of toilet connection apertures defined in the rear portion of the seat frame;

a seat base disposed on the top side of the seat frame that is pivotally coupled to the front side of the seat frame, the seat base being moveable with respect to the seat frame between a depressed position and an extended position, the seat base having a central aperture extending through the seat base, the seat base and frame positionable over the toilet such that the central aperture is positioned over the toilet bowl of the toilet;

a first arm support having a proximate end that is coupled to the first lateral side of the seat frame and a distal end that extends from the top side of the seat frame;

a first arm having a front end and a rear end, the first arm being pivotally coupled to the first arm support about a pivot point located between the front end and the rear end of the first arm, the rear end of the first arm extending beneath the seat base to support the seat base;

a first pneumatic or hydraulic spring positioned adjacent the first lateral side of the seat frame; and a second pneumatic or hydraulic spring positioned adjacent the second lateral side of the seat frame.

* * * * *